US005472372A

United States Patent [19]

Marangoni

[11] Patent Number: 5,472,372

[45] Date of Patent: Dec. 5, 1995

[54] MACHINE FOR SCRAPING TIRES WITH VERTICAL AXIS OF ROTATION OF THE TIRE

[75] Inventor: Giorgio Marangoni, Rovereto, Italy

[73] Assignee: Marangoni Meccanica S.P.A., Italy

[21] Appl. No.: 241,775

[22] Filed: May 12, 1994

[30] Foreign Application Priority Data

May 21, 1993 [IT] Italy ..... MI93A1060

[51] Int. Cl.[6] ..... B24B 7/00

[52] U.S. Cl. ..... 451/123; 451/134

[58] Field of Search ..... 451/123, 134, 451/139, 381, 398

[56] References Cited

U.S. PATENT DOCUMENTS

| | | | |
|---|---|---|---|
| 2,392,667 | 1/1946 | Hawkinson | 451/381 |
| 2,937,676 | 5/1960 | Smyer | 144/288 |
| 2,945,534 | 7/1960 | Hawkinson | 451/381 |
| 2,965,162 | 12/1960 | Hawkinson | 451/381 |
| 3,552,200 | 1/1971 | Hermanns | 73/146 |
| 3,848,368 | 11/1974 | Toshioka et al. | 51/165 |
| 3,867,792 | 2/1975 | Pelletier | 451/134 |
| 3,965,959 | 6/1976 | Weir | 157/13 |
| 4,663,889 | 5/1987 | Strand et al. | 451/134 |

FOREIGN PATENT DOCUMENTS

| | | | |
|---|---|---|---|
| 1493374 | 9/1966 | France . | |
| 1553330 | 1/1968 | France . | |
| 2260444 | 5/1975 | France | B29H 21/01 |
| 2686541 | 7/1993 | France | B26D 3/10 |
| 5200911 | 8/1993 | Japan | B29D 30/68 |

*Primary Examiner*—Bruce M. Kisliuk
*Assistant Examiner*—Derris H. Banks
*Attorney, Agent, or Firm*—Ladas & Parry

[57] ABSTRACT

A machine for scraping tire treads comprising two units (10, 30), one (10) upper and one (30) lower, arranged according to a vertical axis (y—y) for the handling and positioning of a tire (2) in a symmetrical position relative to a horizontal axis (z—z) and for operating the tire in rotation around an axis of rotation coinciding with the vertical axis of such handling and operating units (10, 30). There is further provided a unit (20) for work tools (21) placed in rotation around a vertical axis parallel to the axis of rotation of tire (2) and automatic means (5, 5*a*) for loading/unloading tire (2) on/from lower supporting and positioning unit (30).

9 Claims, 3 Drawing Sheets

Figure 1:
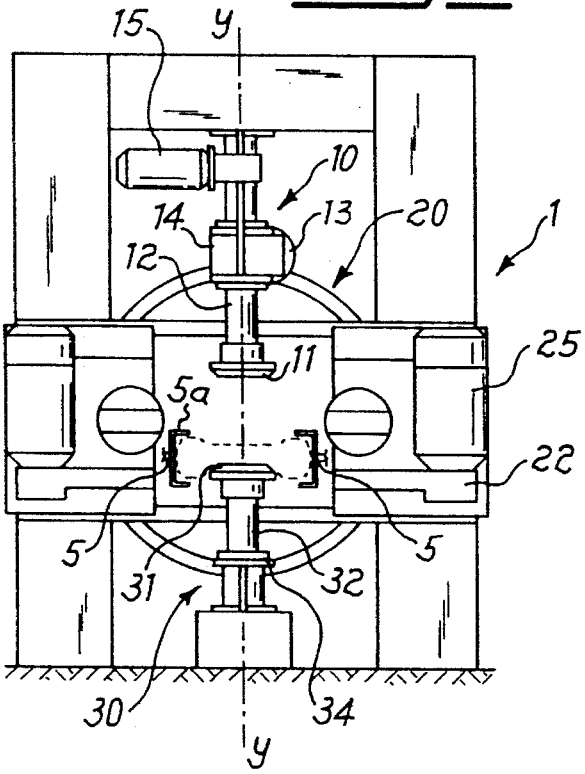

Fig.4
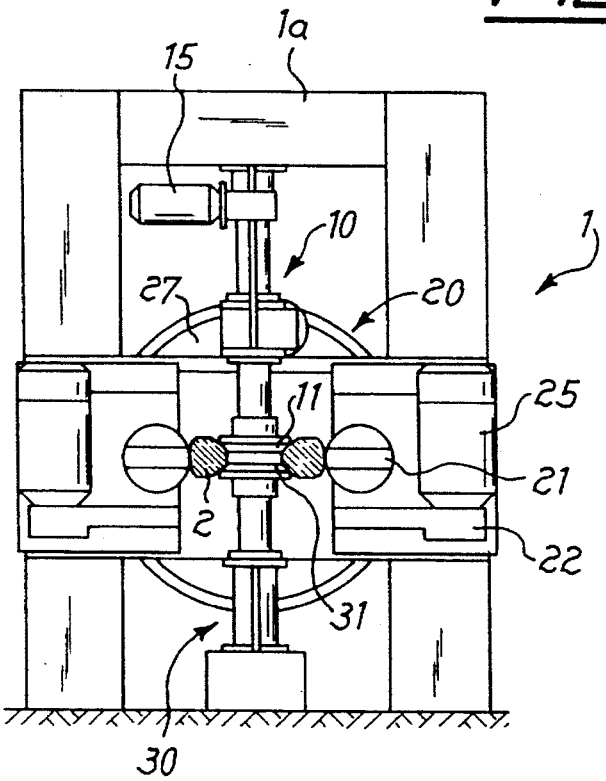
Fig.6
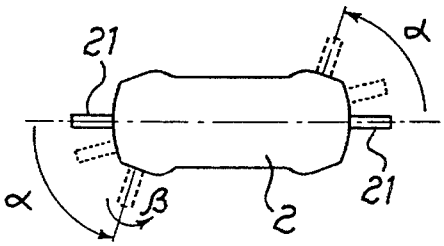
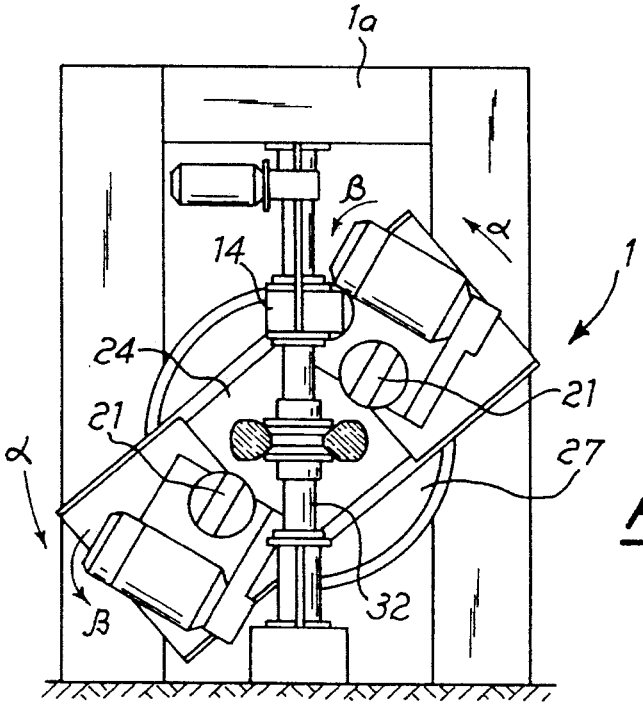
Fig.5

MACHINE FOR SCRAPING TIRES WITH VERTICAL AXIS OF ROTATION OF THE TIRE

The object of this invention is a machine for scraping tire treads with a vertical axis of rotation.

It is known that in the technology of the so-called retreading of tire—that is, the replacement of the old, worn tread with a new tread—it is necessary to perform a preliminary operation to remove the old tread before applying the new one.

There are also known machines capable of performing this operation, commonly known as "scraping", in which provision is made for applying the tire to be processed to a support consisting of two plates maintained at a spacing which corresponds to the original dimensions of inside diameter and thickness of the tire to be processed. In such type of known machine the tire to be processed is positioned on a vertical support having a horizontal axis of rotation; it is therefore obvious that it is necessary to perform difficult and dangerous operations to hold and position the tire once it has been made integral with the support and put under pressure. With such type of machine it is moreover extremely difficult to automate the operations of loading and unloading of the tire on/from the mandrel and to enable the tire supporting plates to adapt to any dimension of the inside diameter of the tire so as to make the mandrel and tire integral with one another in a sealed manner for the inflation of the latter. There is therefore posed the technical problem of providing a tire processing machine which will make it possible to perform all the operations comprising loading and unloading of the tire in an automatic manner and equipped with means of variable diameter for the handling and rotation of the tire in order to adapt the machine to any size of tire without the need to change the said mandrel, thereby also making it possible to avoid having to press tires of different dimensions onto specific tire bead discs suitable only for a particular diameter of tire.

Within the context of such problem there is a further need to provide a compact machine capable of being enclosed within a soundproof cabinet for great safety of work and extraction of processing fumes and dust. Such results are obtained with the present invention, which provides a machine for scraping tire treads comprising two units, one upper and one lower, arranged according to a vertical axis (y—y) for the handling and positioning of a tire in a symmetrical position relative to a horizontal axis (z—z) and for operating the said tire in rotation around an axis of rotation coinciding with the vertical axis of such handling and operating units, there being furthermore provided a unit for the work tools placed in rotation around a vertical axis parallel to the axis of rotation of the tire and automatic means for loading/unloading the tire on/from the lower supporting and positioning unit.

Figure 2:
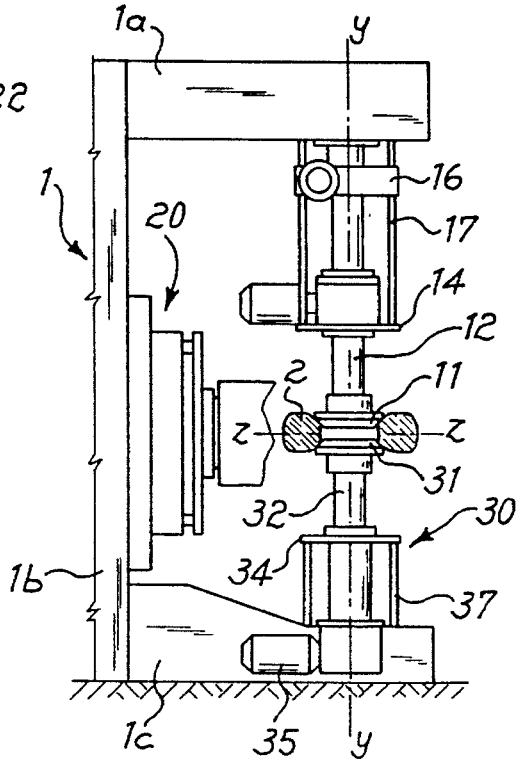
Figure 3:
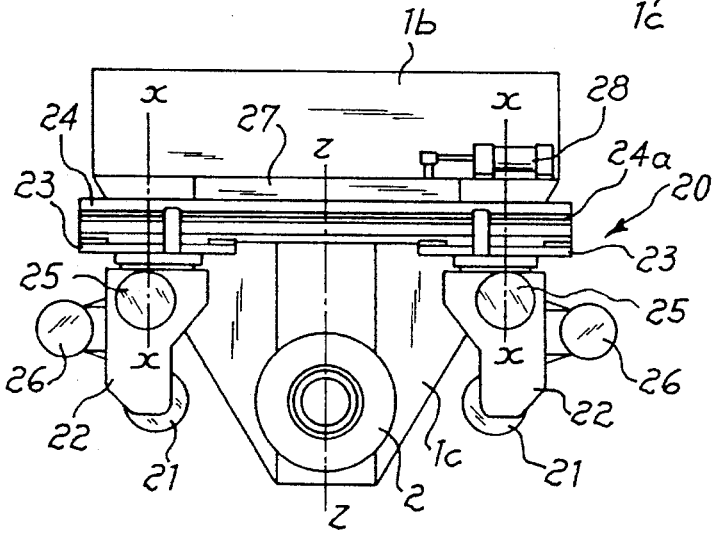
Figure 7:
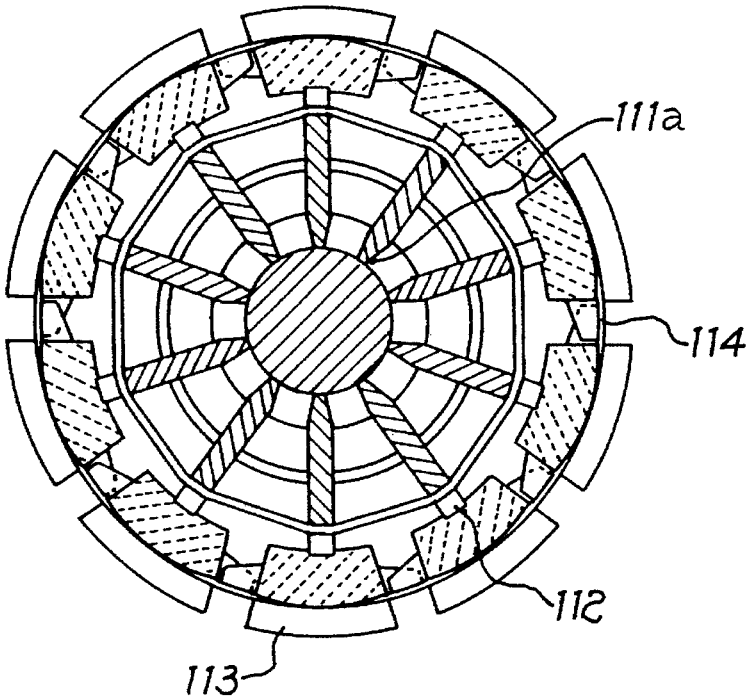

Further details may be obtained from the following description, with reference to the attached drawings, which show:

In FIG. 1: a schematic front view of the machine according to the invention, in the loading phase;

In FIG. 2: a side view of the machine in FIG. 1 with the plates closed;

In FIG. 3: an overhead view of the lower part of the machine in FIG. 1;

In FIG. 4: a schematic front view of the machine in FIG. 1 with the plates closed during the phase of commencement of processing;

In FIG. 5: the machine in FIG. 1 during the processing phase;

In FIG. 6: a diagram of the trajectories followed by the scrapers during processing;

In FIG. 7: a cross-section of the adjustable mandrel, and

Figure 8:
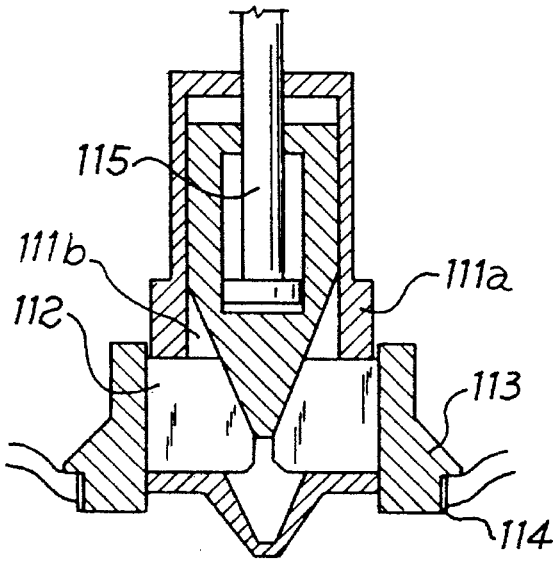

In FIG. 8: a cross-section of the device for regulating the opening of the mandrel.

As shown in FIG. 1 and 2, the machine according to the invention is comprised of a supporting frame 1 substantially of "C" shape, to arms 1*a*, 1*b*, 1*c* of which are respectively made integral upper mandrel unit 10, work tool unit 20 and lower mandrel unit 30.

Upper mandrel unit 10 and lower mandrel unit 30 are both located according to a vertical axis Y—Y which makes it possible to position tire 2 in a horizontal position on lower mandrel 30 (FIG. 1). In greater detail, upper mandrel 10 consists of a tire bead disc 11 fitted to the end of a shaft 12 which is made to rotate by a motor 13 linked in turn to a support 14 which may be made to move axially by a second motor 15 linked to arm 1*a* of frame 1 via guiding means 16 between which slide rods 17 integral with support 14. The parts comprising the transmissions of movement are self-evident and therefore not described in detail.

Upper mandrel 10 is thus provided with natural movement both by translation along vertical axis Y—Y and by rotation around the same axis.

Lower mandrel unit 30 comprises instead a tire bead disc 31 made integral with a shaft 32, integral in turn with a support 34 which may be made to move according to axis Y—Y via a motor 35 and guiding means 37.

Again in this case the parts comprising the transmissions are of known type and are therefore not described in detail but only shown schematically in the figures.

The lower mandrel 30 is thus provided with natural movement only for translation along axis Y—Y, whilst it is idle for rotation around the same axis.

Work tool unit 20 comprises in turn a pair of rotary tools 21, commonly known as scrapers, rotationally mounted on supports 22 symmetrically arranged on either side of a horizontal axis Z—Z which intersects the vertical axis Y—Y and therefore in diametrically opposed position relative to tire 2 to be processed (FIG. 3). Each support 22 may travel horizontally in both directions in order to move scraper 21 close to/away from the surface of tire 2 by means of a carriage 23 sliding on guides 24*a* of a plate 24 under the action of a motor, not shown; each scraper 21 is made to rotate by means of motors 26.

Plate 24 is furthermore made integral with a pivot 27 rotationally integral with support 1*b* and operated in rotation by an actuator 28 which causes to be performed by the said pivot and therefore by the whole of unit 20 a rotation according to a programmed alpha angle (FIGS. 5 and 6) in relation to the size of the tire being processed. Each support 22 may then perform a beta rotation around its own axis x—x (FIG. 3) under the action of a motor 25 housed in the said support in order to maintain the working surface of scraper 21 always tangential to the surface of tire 2 during the rotation according to an alpha angle performed by the scraper around the said surface (FIG. 6), thus ensuring regularity of scraping of the surface of tire 2. As shown schematically in FIG. 1, loading and unloading of tire 2 to be processed may be carried out by means of an automatic loader with digital control having arms 5 fitted with clamps 5*a* which close onto the edge of the tire and position it on the lower mandrel 30 at the start of processing and then remove it at the end of processing. The operation of the machine is as follows: at the start of processing upper mandrel 10 is raised, the lower mandrel 30 is lowered and the work tools are located at the outward end of their stroke, so as to allow as much space as possible for loading. At this point, arm 5 of the loader positions tire 2 on the lower mandrel 30 and initiates the procedure for placing the scraper tools 21 in contact with the surface of the tire and for the subsequent scraping of the latter based on the parameters determined by the programme.

On completion of processing the scraper tools 21 assume their initial setting to facilitate unloading of the tire being processed and loading of the next tire to be processed.

Many variants may be introduced without thereby departing from the scope of the invention in regard to its general features. In particular, it is possible to provide clamping and rotating mandrels of variable diametrical dimension in order to adapt the machine to any size of tire without the need to change the said mandrels, it being also possible in this way to avoid having to press tire of different sizes onto specific tire bead discs suitable only for a particular size of tire.

As shown in FIGS. 7 and 8, tire bead disc 111 of variable dimensions is comprised of a cylindrical body 111*a* having at its outer end radial grooves 111*b* within which slide pushers 112 integrally with each of which is fitted a circular segment 113.

Around each of the circular segments is fitted a rubber ring 114 capable of handling and inwardly compressing the various segments. Inside cylindrical body 111a is furthermore located an actuator 115 with a tapered end which is capable of bringing about the expansion of the various pushers 112 with relevant segments 113 and consequently of locking the tire which may be inflated to the required pressure.

I claim:

1. A machine for scraping treads of a tire, said machine comprising an upper and lower units rotatably mounted about a vertical axis of the machine for handling and positioning the tire in a horizontal position symmetrically relative to a horizontal axis, which intersects with the vertical axis, so that the tire is clamped by said two units and rotatable therewith about said vertical axis, a work tool unit mounted adjacent the tire and on the horizontal axis, and carrying thereon a pair of work tools which are disposed symmetrically with respect to said vertical and horizontal axes, and rotatable respectively about their own vertical axes parallel to the vertical axis of the machine, and means for automatically loading/unloading the tire on/from said lower unit.

2. The machine of claim 1, wherein said upper handling unit includes a shaft operated in translation along said vertical axis and in rotation about the same axis via appropriate motors.

3. The machine of claim 1, wherein said lower handling unit comprises a shaft operated in translation along the vertical axis via a motor and is idle for rotation.

4. The machine of claim 1, wherein said work tool unit comprises a pair of supports for supporting said pair of tools, said supports capable of moving substantially horizontally to move the tools toward or away from the tire, and a plate disposed diametrically opposed to the tire and including guides for the moving of said supports, said plate being rotatable about the horizontal axis of symmetry of the tire by means of an actuation assembly.

5. The machine of claim 4, wherein said supports for said tools are capable of rotating around respectively a horizontal axis parallel to said horizontal axis of symmetry of the tire, in order to maintain a position of tangential contact between said tools and the surface of the tire during the rotation of said plate around said horizontal axis of symmetry.

6. The machine of claim 1, wherein said means of automatically loading/unloading include arms fitted with clamps, and are controlled in position by means of digital control for the clamping and positioning of the tire on said lower handling unit.

7. The machine of claim 1, wherein said upper and lower units comprise tire bead discs with variable dimensions, said tire bead discs including a cylindrical body having at its outer end a plurality of radial grooves within which slide pushers are integrated, each of said pushers being fitted with a circular segment means for operating the pushers, and means for sealing and inflating the tire to a programmed pressure.

8. The machine of claim 7, wherein said sealing means comprises a rubber ring capable of inwardly compressing the various segments.

9. The machine of claim 7, wherein an actuator is provided to operate said pushers, said actuator having a tapered end which is capable of bringing about an expansion of the pushers with relevant said segments.

* * * * *

UNITED STATES PATENT AND TRADEMARK OFFICE

CERTIFICATE OF CORRECTION

PATENT NO. : 5,472,372
DATED : December 5, 1995
INVENTOR(S) : Giorgio MARANGONI

It is certified that error appears in the above—identified patent and that said Letters Patent is hereby corrected as shown below:

Column 2, line 54, after "rotation" insert --(FIGS. 5 and 6)--
Column 3, line 18, change "tire" to --tires--

Signed and Sealed this

Twenty-ninth Day of October 1996

Bruce Lehman

*Attest:*

BRUCE LEHMAN

*Attesting Officer*

*Commissioner of Patents and Trademarks*